US010821462B2

(12) United States Patent
Lujan et al.

(10) Patent No.: US 10,821,462 B2
(45) Date of Patent: Nov. 3, 2020

(54) UTILITY RECEPTACLE SHIELDING INSERT

(71) Applicant: Charles A. Lujan, Thornton, CO (US)

(72) Inventors: Charles A. Lujan, Thornton, CO (US); Ronald A. Angstead, Lontmont, CO (US)

( * ) Notice: Subject to any disclaimer, the term of this patent is extended or adjusted under 35 U.S.C. 154(b) by 0 days.

(21) Appl. No.: 15/932,032

(22) Filed: Jan. 26, 2018

(65) Prior Publication Data

US 2019/0232314 A1 Aug. 1, 2019

(51) Int. Cl.

| | |
|---|---|
| ***B05B 12/26*** | (2018.01) |
| ***E04G 23/02*** | (2006.01) |
| ***B05C 21/00*** | (2006.01) |
| ***B05B 12/24*** | (2018.01) |
| *B05D 1/32* | (2006.01) |

(52) U.S. Cl.

CPC ..... *B05B 12/26* (2018.02); *B05C 21/005* (2013.01); *E04G 23/0207* (2013.01); *B05B 12/24* (2018.02); *B05D 1/32* (2013.01)

(58) Field of Classification Search

CPC ..... B05B 12/26; B05B 12/24; B05C 21/005
See application file for complete search history.

(56) References Cited

U.S. PATENT DOCUMENTS 3,015,408 A * 1/1962 Campbell ..... H02G 3/14 220/3.4
4,475,147 A * 10/1984 Kristofek ..... F21S 8/026 362/147
4,825,805 A * 5/1989 Walker ..... B05B 12/20 118/504
4,879,158 A * 11/1989 Horiki ..... B05B 12/26 428/159
5,270,085 A 12/1993 Horiki et al.
5,328,723 A * 7/1994 Horiki ..... B05B 12/26 427/272
5,420,775 A 5/1995 Kusmer
5,526,952 A 6/1996 Green
6,103,974 A * 8/2000 Erdfarb ..... B05B 12/20 174/66
6,803,522 B2 10/2004 Skakun
7,022,187 B2 * 4/2006 Stockton ..... B05B 12/26 118/504
7,186,917 B1 * 3/2007 Van De Wiele, Jr. ... H02G 3/12 174/66
7,511,218 B2 * 3/2009 Kearney ..... H02G 3/12 174/66
8,723,037 B1 5/2014 Matsumoto
9,061,305 B1 * 6/2015 Martinez ..... B05B 12/20
2003/0186017 A1 * 10/2003 Stockton ..... B05B 12/26 428/64.1
2007/0187127 A1 * 8/2007 Compagnone, Jr. ... H02G 3/126 174/58
2017/0320088 A1 * 11/2017 Cohen ..... H01H 29/08
2017/0323745 A1 * 11/2017 Cohen ..... H01R 13/447
2017/0324232 A1 * 11/2017 Cohen ..... F21S 8/026

* cited by examiner

*Primary Examiner* — Karl Kurple
(74) *Attorney, Agent, or Firm* — Harold A. Burdick

(57) ABSTRACT

A stackable shield removably insertable in an opening to an interior of a recessed light fixture receptacle is disclosed. The unit is characterized by a v-shaped divider structure defined by first and second divider walls extending between opposite parts of the outer wall. Configuration of the outer wall is alterable by urging the divider walls toward one another.

19 Claims, 8 Drawing Sheets

UTILITY RECEPTACLE SHIELDING INSERT

FIELD OF THE INVENTION

The invention relates to accessories for use during application of ceiling or wall finishing treatments such as dry wall compound (or mud), plaster, paint or the like, and, more particularly, relates to devices for shielding during such application receptacles accommodating electrical, heating and/or plumbing utilities commonly located through the surface of walls and ceilings.

BACKGROUND OF THE INVENTION

Utility receptacles of various kinds are installed during construction of buildings to accommodate location of services thereat such as lights and electrical controls, heating and plumbing and related controls, and a variety of other utilities such as communications and safety equipment. These receptacles must remain accessible through the walls and ceilings after the walls and ceilings are finished, whereupon the utilities and controls, finish panels and the like are installed. To prevent the receptacles from becoming contaminated with the various finish treatments applied to walls and ceilings, the finish crew must cover and/or tape over the receptacle openings in some fashion. This job is tedious and time consuming and often results in less than ideal finish around the receptacle (from uneven covering or cracking and peeling of finish during tape removal for example).

Various devices have been heretofore suggested and/or utilized to facilitate elimination of this step in the wall and ceiling finishing processes. Inserts have been suggested which require special tools and/or attachment devices to secure them at the receptacle (see, for example, U.S. Pat. Nos. 7,022,187, 5,270,085 and 5,420,775). Various covers, both of a rigid variety and a flexible variety, have also been suggested which are applied over existing utility installations in receptacles (and are thus used primarily for remodel or redecorating operations; see U.S. Pat. Nos. 6,803,522, 8,723,037, 5,526,952 and 6,103,974).

Such devices have not found wide acceptance in the trades, however, likely due to expense of production and tooling and/or ongoing expense for fasteners, specialty tools and restocking. Many, including those requiring specialty tools and fasteners, present a storage and transport problem for installers, for example not being conveniently stackable for transport to or between job sites. Moreover, some heretofore suggested devices may not remain secure during finishing treatments, particularly where surfaces remain wet, and/or the devices present protruding portions extending away from the surface thereby imposing undesirable surface characteristics, such as impediments and incongruities, for finishers during treatment applications. Moreover, where the receptacle openings are relatively large, and particularly where the openings are curved, such as is common with recessed light fixture receptacles (for example, fixtures receptacles having a cylindrical opening portion and commonly referred to as "can lights"), securement and retention of such devices becomes difficult. These difficulties have not been overcome heretofore. Further improvements could thus still be utilized.

SUMMARY OF THE INVENTION

This invention provides a shielding insert (hereinafter variously referred to as an insert, unit or shield) to mask, or shield, the opening of a recessed light fixture or other recessed utility receptacle typically located through walls or ceilings of various buildings from material contamination during construction, including surface treatment of the adjacent wall or ceiling. The shield is removably locatable by inserting it into the receptacle opening and is flush with the surface where the opening is defined once positioned. The insert can be manufactured from plastic, metal or molded pulp product for washing and reuse, or paperboard, cardboard, or molded pulp product for either reusable or disposable use. The insert is inexpensive to produce, is compact for storage and transport, can be conveniently produced in a number of sizes and configurations, is secure once installed, is easily removed when wall or ceiling treatment is complete, and requires no special tools or fasteners for use.

The shielding insert of this invention provides a unit having an outer wall defining an interior area, the outer wall defined by first and second spaced bounds. A periphery slightly larger than the receptacle opening is located at the first bound and the second bound is smaller than the receptacle opening. A continuous outer rim extends outwardly from the interior area at the first bound and a closure extends inwardly across the interior area at the second bound. A divider structure (preferably having a v-shaped cross section) extends between opposite parts of the outer wall across the interior area dividing the area into two sections, the divider structure having first and second bounds extending from the first and second bounds of the outer wall, respectively.

More particularly, the divider structure is preferably defined by first and second divider walls extending between the opposite parts of the outer wall. The first bound of the divider structure is located at an apex of the divider walls and the second bound thereof is located at a linear edge structure including first and second spaced linear edges defined between the first and second divider walls and first and second closure portions, one at each section of the interior area. Configuration of the outer wall is thus alterable by urging of the divider walls of the divider structure toward one another by a user. The units are stackable along the divider structure (i.e., compactly stackable on each other along the first and second divider walls of the divider structure when not in use).

The insert of this invention is particularly suitable for shielding an interior of a cylindrical recessed light fixture receptacle having a circular lip opening thereinto through a wall or ceiling from intrusion thereinto of foreign substances during construction activities including wall or ceiling surface treatments. The continuous outer rim extends outwardly from first and second wall portions at different ones of the sections of the interior area which together define the outer wall. The first and second bounds of the outer wall are spaced curvilinear bounds, the circumferential periphery of the first bound being slightly larger than the receptacle opening at the first bound. The divider structure extends between opposite parts of the outer wall where the wall portions each terminate and across the interior area dividing the interior area with each section thereof bounded by a different one of the wall portions. The outer wall, the closure portions and the divider structure are thereby configured so that the divided interior area is completely isolated from the interior of the receptacle and the interior of the receptacle is completely closed at the opening thereinto when the insert is positioned through the receptacle opening with the rim in contact with the wall or ceiling.

It is therefore an object of this invention to provide an insert for shielding the interior of a recessed light fixture or other recessed utility receptacle from material contamination during surface treatment of the adjacent wall or ceiling.

It is another object of this invention to provide a shielding insert that is removably locatable in a utility receptacle opening and is flush with the adjacent surface where the opening is defined once positioned.

It is still another object of this invention to provide an insert for shielding the interior of a utility receptacle that can be manufactured for reuse or disposal and that is stackable.

It is yet another object of this invention to provide a shielding insert for utility receptacles that is inexpensive to produce, is convenient to store and transport, is secure once installed and easily removed when wall or ceiling treatment is complete, and that requires no special tools or fasteners for use.

It is another object of this invention to provide a shielding insert engageable in a utility receptacle opening, the insert comprising a unit having an outer wall defining an interior area, the outer wall having first and second spaced bounds, with a periphery slightly larger than the receptacle opening at the first bound and smaller than the receptacle opening at the second bound, a rim extending outwardly from the interior area at the first bound of the outer wall and a closure extending inwardly across the interior area at the second bound, a divider structure extending between opposite parts of the outer wall across the interior area dividing the area into two sections, the divider structure having first and second bounds extending from the first and second bounds of the outer wall, respectively.

It is still another object of this invention to provide a stackable shield removably insertable in an opening to a recessed light fixture receptacle including a unit engageable in the receptacle opening and characterized by a divider structure extending from opposite parts of an outer wall across an interior area defined by the outer wall, the divider structure defined by first and second divider walls extending between the opposite parts of the outer wall, the divider structure having a first bound at an apex of the divider walls and a second bound located at spaced linear edges defined between the first and second divider walls and first and second closure portions extending from the outer wall across the interior area, respectively, configuration of the outer wall being alterable by urging of the divider walls of the divider structure toward one another by a user, and plural units compactly stackable on each other along the first and second divider walls of the divider structure when not in use.

It is yet another object of this invention to provide an insert for shielding an interior of a recessed light fixture receptacle having a cylindrical opening thereinto through a wall or ceiling from intrusion thereinto of foreign substances during wall or ceiling surface treatments, the insert comprising a unit having a continuous outer rim extending outwardly from first and second wall portions together defining an outer wall defining an interior area, the outer wall having first and second spaced curvilinear bounds, with a circumferential periphery slightly larger than the receptacle opening at the first bound and the second bound smaller than the receptacle opening, first and second closure portions extending inwardly across the interior area at the second bound, a divider structure extending between opposite parts of the outer wall where the wall portions each terminate and across the interior area dividing the interior area into sections with each bounded by a different one of the wall portions, the divider structure having first and second bounds extending from the first and second bounds of the outer wall, respectively, the second bound of the divider structure located at a linear edge structure defined between the divider structure and the first and second closure portions, the outer wall, the closure portions and the divider structure configured so that the divided interior area is completely isolated from the interior of the receptacle and the interior of the receptacle is completely closed at the opening thereinto when the insert is positioned through the receptacle opening with the rim in contact with the wall or ceiling.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
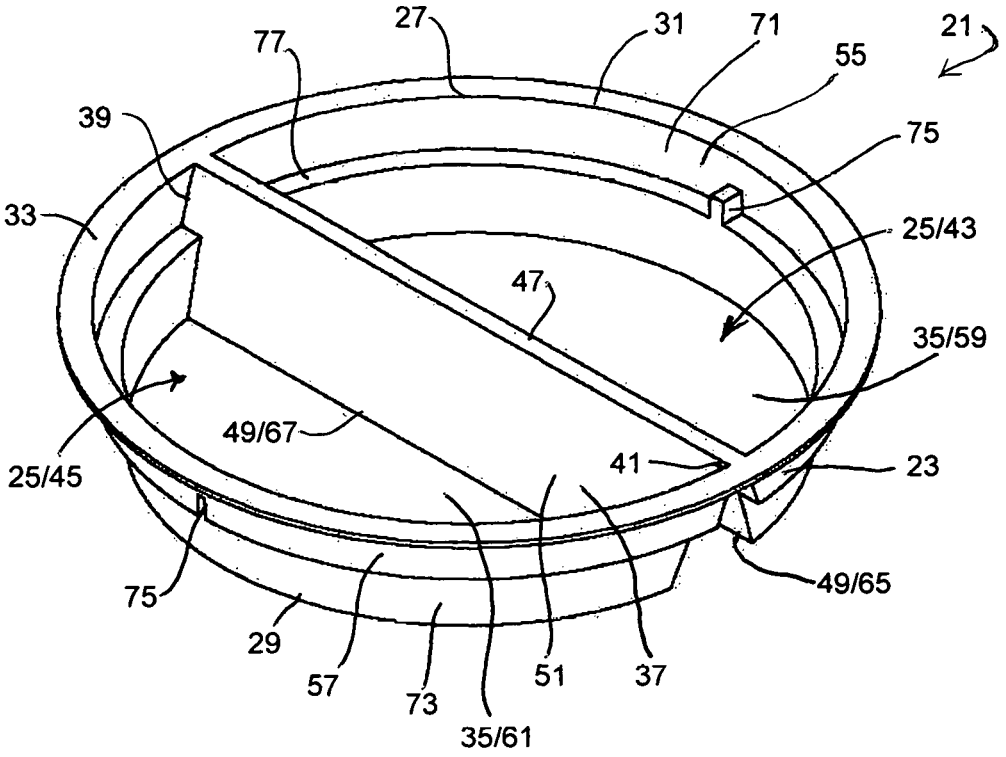
FIG. 1 is a perspective view of a first construction of the preferred embodiment of the shielding insert of this invention.
Figure 2:
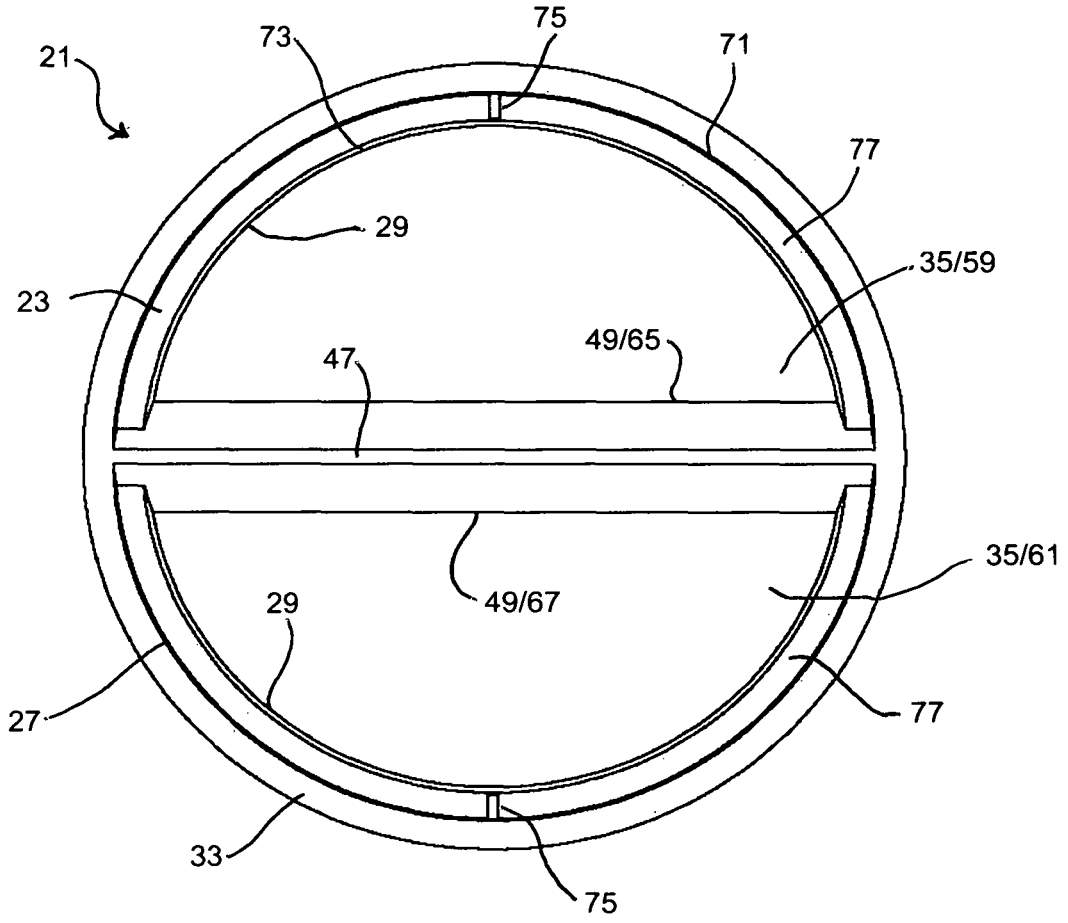
FIG. 2 is a top view of the insert of FIG. 1.
Figure 3:
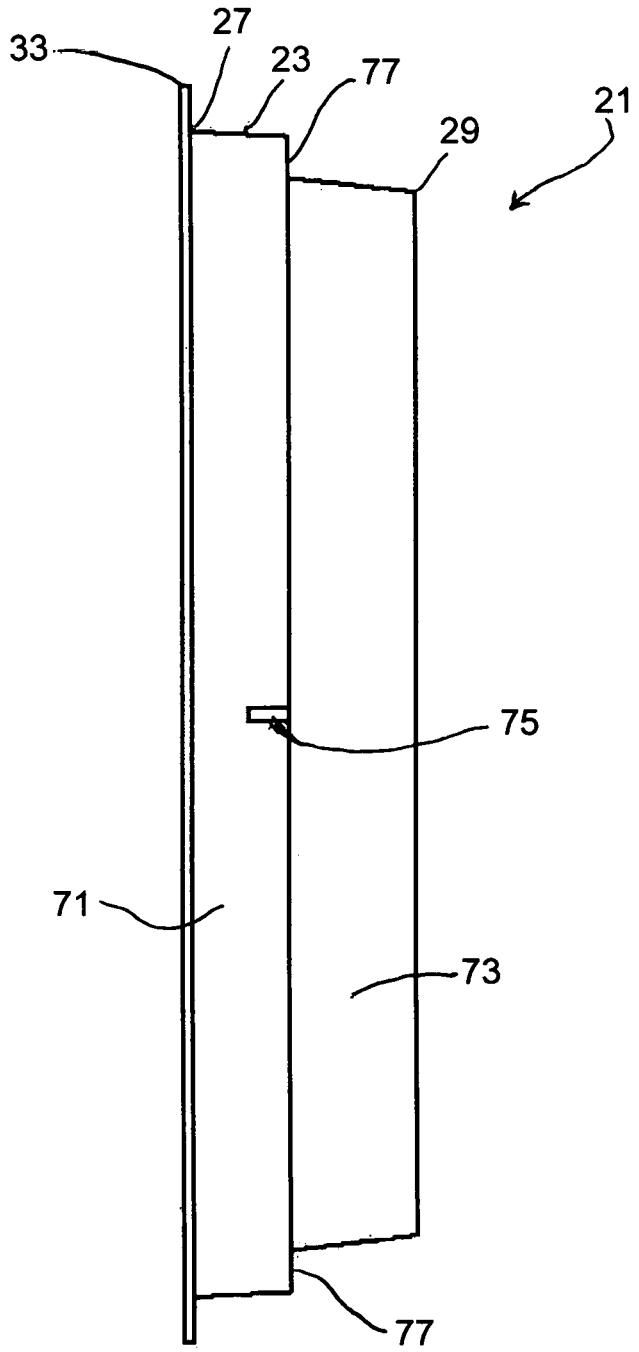
FIG. 3 is a side view of the insert of FIG. 1.
Figure 4:
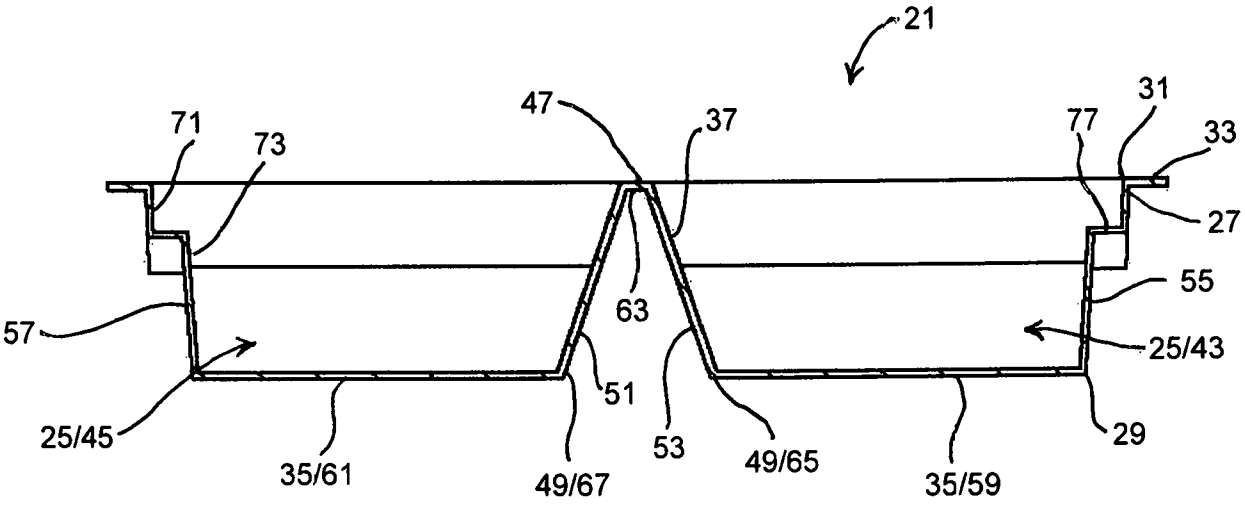
FIG. 4 is a sectional illustration of the insert of FIG. 1.

A first construction 21 of the preferred embodiment of the shielding insert of this invention is shown in FIGS. 1 through 4, this construction being particularly suitable for manufacture from plastic, metal, or other washable and reusable materials. The insert shown in the FIGURES is adapted for use with receptacles for recessed lighting fixtures (can light fixtures, for example), and is removably insertable into the body of the receptacle to keep material out during construction, wall treatment and the like. Other configurations adapted for use with different utility receptacles or different receptacle sizes can be provided which utilize the teachings of this disclosure, and thus are deemed to be within the scope of the invention claimed herein.

Shielding insert 21 is preferably a monolithic unit (molded for example). The unit includes an outer wall 23 defining an interior area 25. Outer wall 23 is defined between first and second spaced bounds 27 and 29 (the extents of the wall, top and bottom in FIG. 1, though those terms are relative depending on the orientation of the unit), with periphery 31 (slightly larger than the receptacle opening for which it is intended) at bound 27. Second bound 29 is smaller than the intended receptacle opening and thus first bound 27.

Continuous rim 33 extends outwardly from interior area 25 at first bound 27 of outer wall 23 and covers the lip of the receptacle when the unit is positioned therein. Closure wall 35 extends inwardly across interior area 25 at second bound 29. Divider structure 37 extends between opposite parts 39 and 41 of outer wall 23 across interior area 25 dividing the area into two sections 43 and 45 (preferably of substantially similar dimensionality). Divider structure 37 includes first and second bounds 47 and 49, respectively, extending from first and second bounds 27 and 29 of outer wall 23, respectively.

Divider structure 37 preferably has a v-shaped cross section (see FIG. 4) defined by first and second divider walls 51 and 53, respectively, both extending between opposite parts 39 and 41 of outer wall 23 thus defining first and second outer wall portions 55 and 57 and first and second closure portions 59 and 61 at interior area sections 43 and 45, respectively, with each section bounded by a different one of the wall portions. Outer wall portions 55 and 57 each originate and terminate at opposite parts 39 and 41 at divider structure 37. First bound 47 of divider structure 37 is located at apex 63 of divider walls 51 and 53, and second bound 49 of divider structure 37 is defined by a linear edge structure including first and second spaced linear edges 65 and 67 at the juncture of first and second divider walls 53 and 51 and first and second closure portions 59 and 61, respectively.

Outer wall 23 in the unit of construction 21 includes first and second stepped sections 71 and 73, respectively, between first and second spaced bounds 27 and 29, first stepped section 71 having periphery 31 thereat. Reliefs 75 are formed at a ledge 77 defined between first and second stepped sections 71 and 73 and through first stepped section 71 thereat (see FIGS. 2 and 3). Reliefs 75 are preferably located 180° apart and 90° from wall parts 39 and 41 of outer wall 23. Insert 21 is formed of material selected so that divider walls 51 and 53 of divider structure 37 can be urged toward one another by a user thereby altering configuration of periphery 31 and outer wall 23 (as accommodated by reliefs 75) at first bound 27 thereof. Such materials include plastic, metal or molded pulp product, all of which may be made washable and reusable or disposable. Units 21 are compactly stackable on each other along the divider walls when not in use.

For units 21 of this invention used with cylindrical recessed lighting receptacles as illustrated herein, the walls and bounds thereof are curvilinear formations, with a circumferential periphery. For use, for example, with a 6" (152.4 mm) can light fixture receptacle, unit 21 between bounds 27 and 29 is about 1.2" (30.48 mm) thick. Periphery 31 preferably has a diameter of about 6.11" (155.19 mm), wall section 71 tapering therefrom to a diameter of about 6.075" (154.32 mm) at ledge 77. Second wall section 73 at ledge 77 preferably has a diameter of about 5.64" (143.12 mm) and tapers to a diameter of about 5.54" (140.72 mm) at second bound 29. This configuration of outer wall 23, closure portions 43 and 45, and divider structure 37 isolates interior area 25 from the interior of the receptacle. The interior of the receptacle is thus completely closed at the opening thereinto when insert 21 is positioned through the receptacle opening with rim 33 in contact at its underside with the wall or ceiling having the receptacle opening therethrough.

Figure 5:
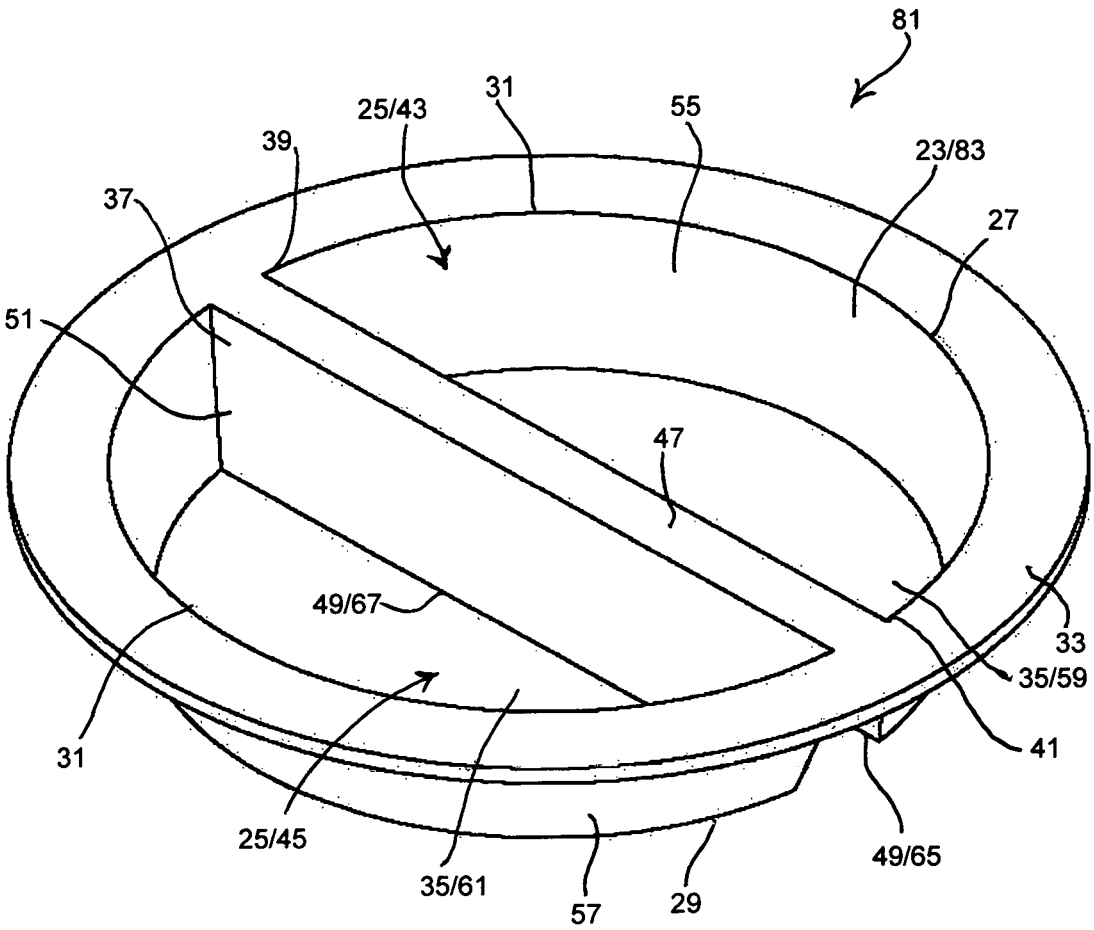
FIG. 5 is a perspective view of a second construction of the preferred embodiment of the shielding insert of this invention.
Figure 6:
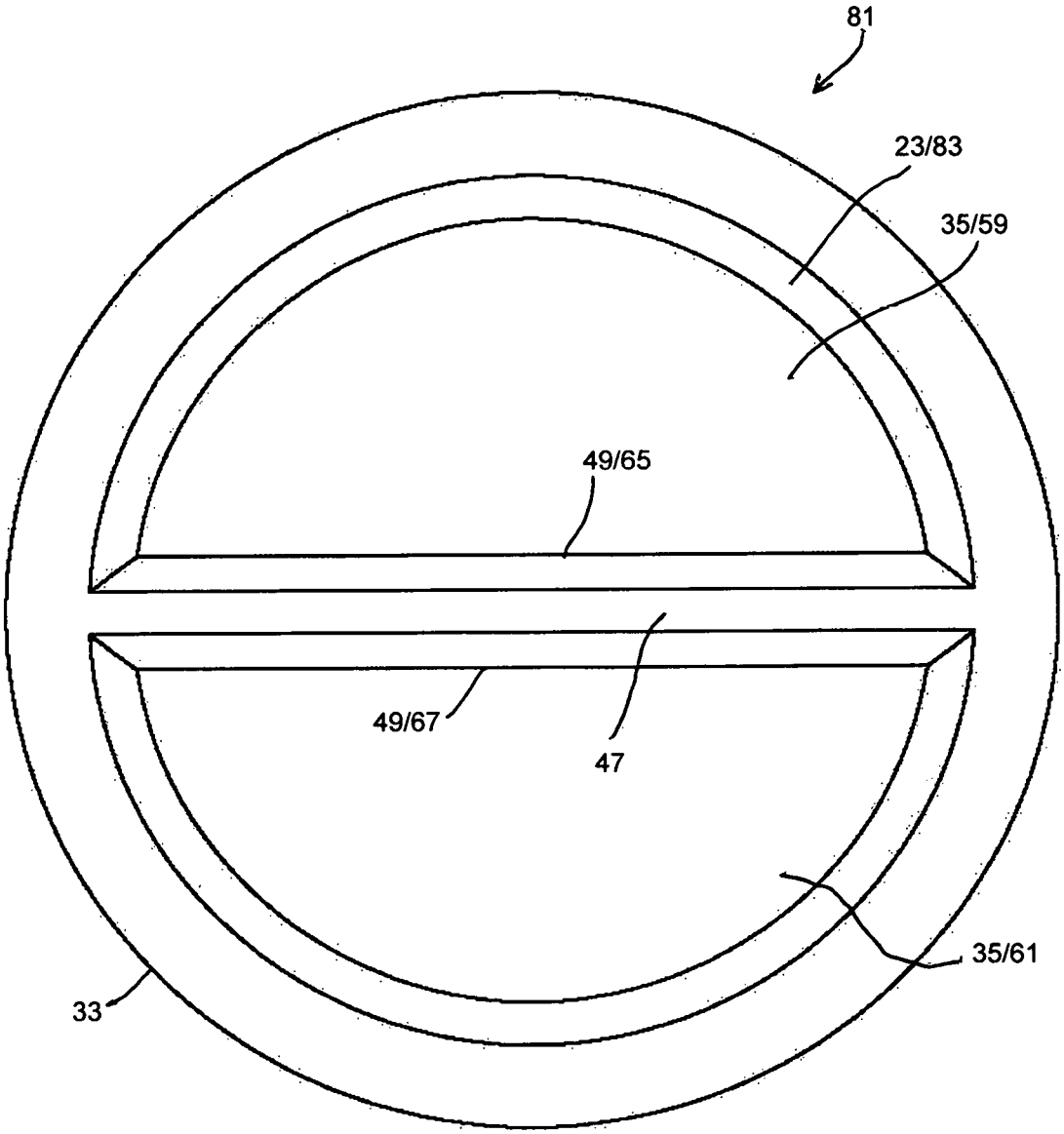
FIG. 6 is a bottom view of the insert of FIG. 5.
Figure 7:
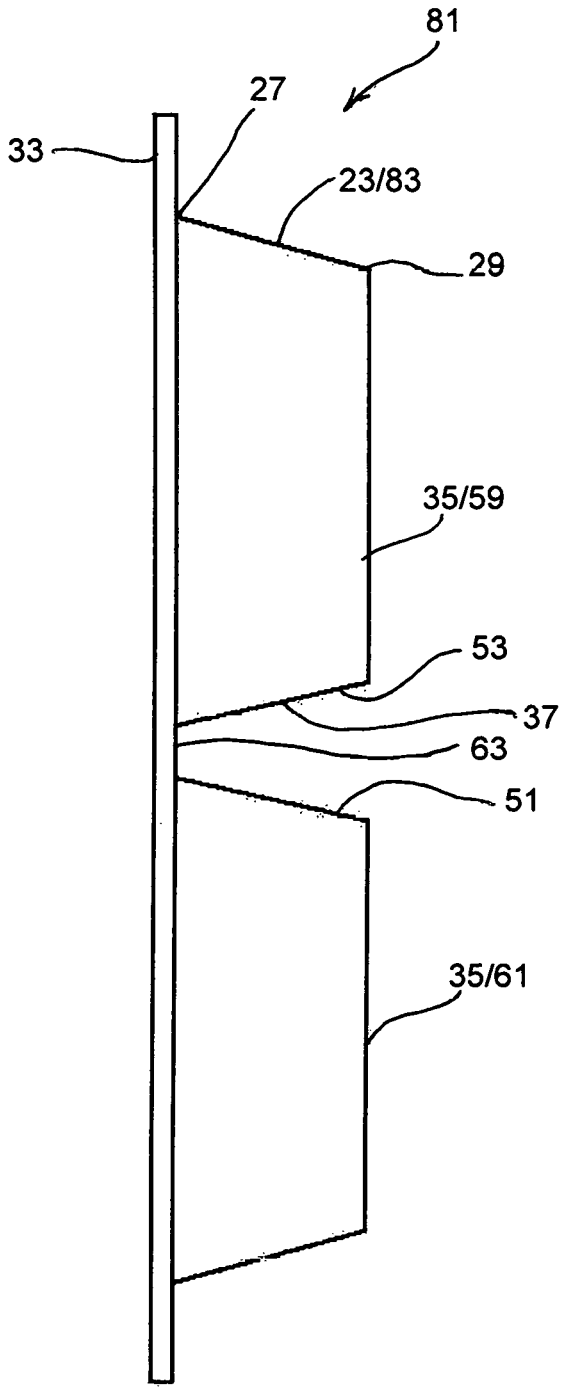
FIG. 7 is a side view of the insert of FIG. 5.
Figure 8:
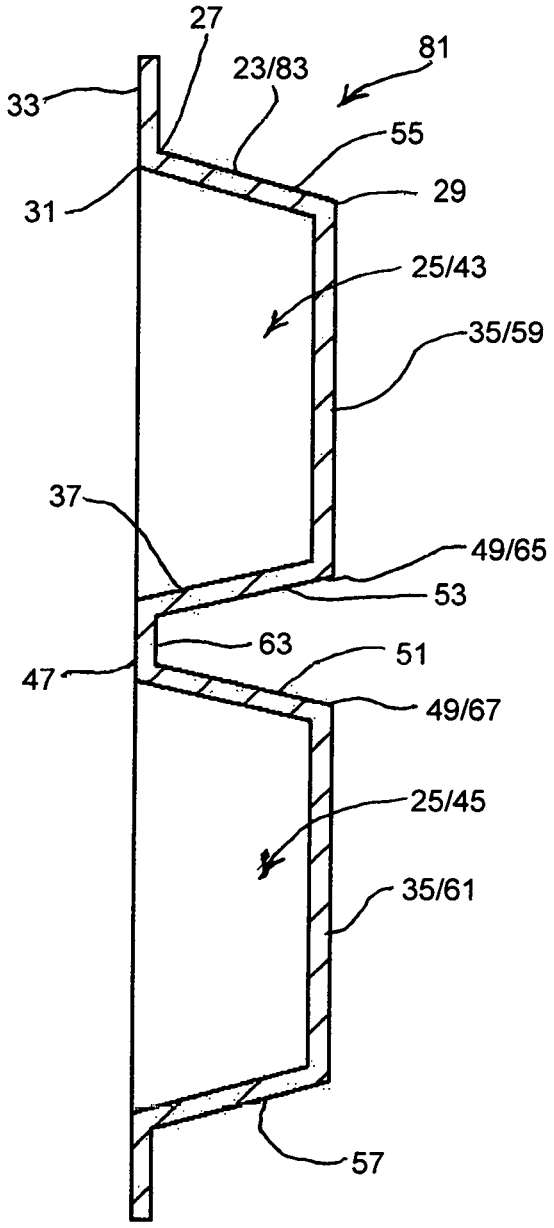
FIG. 8 is a sectional illustration of the insert of FIG. 5.

Turning now to FIGS. 5 through 8, a second construction 81 of the preferred embodiment of this invention is shown particularly well adapted for manufacture from disposable materials such as paperboard, cardboard, or molded pulp products. Shielding insert 21 is again preferably a monolithic formation and includes many of the features identified above (which are identified by the same component identifying numerals). Herein, outer wall 23 has no separate sections, the wall construction being a truncated (i.e., incomplete both circumferentially and longitudinally) conical formation 83 between first and second spaced bounds 27 and 29. For use, again by way of example, with a 6" (152.4 mm) can light fixture receptacle, unit 81 between bounds 27 and 29 is about 1.08" (27.31 mm) thick. Periphery 31 at bound 27 preferably has a diameter of about 6.1" (154.94 mm) and tapers therefrom to a diameter of about 5.5" (139.7 mm) at second bound 29.

In use, the units 21 and 81 of this invention are simple to install and remove. A simple squeeze of divider structure 37 by the installer, thereby urging divider walls 51 and 53 toward one another, alters the configuration (diametric dimension of periphery 31) of outer wall 23 at bound 27 allowing easy insertion of the unit into the opening to the receptacle. Release of divider structure 37 when rim 33 is brought flush to the wall or ceiling and in contact with the lip at the opening into the receptacle allows return to normal dimensionality whereupon the unit is maintained firmly in place in the receptacle opening. When construction is completed, a simple squeeze of divider structure 37 allows unit withdrawal.

As may be appreciated from the foregoing, a shielding insert is provided by this invention which is removably insertable in an opening to a recessed utility receptacle. The units of this invention are well adapted for shielding an interior of a cylindrical recessed light fixture receptacle having an opening thereinto through a wall or ceiling from intrusion thereinto of foreign substances during wall or ceiling surface treatments. They may be washable and reusable, or may be made of disposable materials. The units are compactly stackable for storage.

What is claimed is:

1. A shielding insert engageable in a utility receptacle opening, said shielding insert comprising: a unit having an outer wall defining an interior area, said outer wall having a first bound and a second bound, said first and second bounds of said outer wall spaced from one another, with a periphery larger than the utility receptacle opening at said first bound and said second bound smaller than the utility receptacle opening, a rim extending outwardly from said interior area at said first bound of said outer wall and a closure extending inwardly across said interior area at said second bound, a divider structure having a v-shaped cross section extending between opposite parts of said outer wall completely across said interior area dividing said interior area into two sections, said divider structure having a first bound and a second bound extending from said first bound and said second bound of said outer wall, respectively, wherein said unit is formed of a material selected so that said divider structure can be manipulated by a user to thereby alter a configuration of said periphery of said outer wall to accommodate installation and removal of said shielding insert.

2. A shielding insert engageable in a utility receptacle opening, said insert comprising a unit having an outer wall defining an interior area, said outer wall having a first bound and a second bound, said first and second of said outer wall spaced from one another, with a periphery larger than the utility receptacle opening at said first bound and said second bound smaller than the utility receptacle opening, a rim extending outwardly from said interior area at said first bound of said outer wall and a closure extending inwardly across said interior area at said second bound, a divider structure extending between opposite parts of said outer wall completely across said interior area dividing said interior area into two sections, said divider structure having a first bound and a second bound extending from said first bound and said second bound of said outer wall, respectively, wherein said divider structure has a v-shaped cross section defined by first and second divider walls extending between said opposite parts of said outer wall and wherein said closure includes first and second portions, said first bound of said divider structure located at an apex of said divider walls and said second bound of said divider structure located at spaced linear edges defined between said first and second divider walls and said first and second portions of said closure, respectively.

3. The shielding insert of claim 2 wherein said unit is formed of a material selected so that said divider walls of said divider structure can be urged toward one another by a user thereby altering a configuration of said periphery of said outer wall at said first bound thereof.

4. The shielding insert of claim 1 wherein said unit is a washable and reusable construction of plastic, metal, or molded pulp product.

5. The shielding insert of claim 1 wherein said outer wall includes first and second outer wall portions each originating and terminating at said opposite parts at said divider structure.

6. The shielding insert of claim 1 wherein said outer wall includes first and second stepped sections between said first and second bounds of the outer wall.

7. The shielding insert of claim 6 wherein said first stepped section of said outer wall has said periphery thereat, and wherein reliefs are formed at a ledge defined between said first and second stepped sections of said outer wall and through said first stepped section thereat.

8. A shielding insert engageable in a utility receptacle opening, wherein the utility receptacle opening to be engaged is an opening to an interior of a recessed light fixture receptacle, said insert comprising a unit having an outer wall defining an interior area, said outer wall having a first bound and a second bound, said first and second bounds of said outer wall spaced from one another, with a periphery larger than the utility receptacle opening at said first bound and said second bound smaller than the utility receptacle opening, a rim extending outwardly from said interior area at said first bound of said outer wall and a closure extending inwardly across said interior area at said second bound, a divider structure extending between opposite parts of said outer wall completely across said interior area dividing said interior area into two sections, said divider structure having a first bound and a second bound extending from said first bound and said second bound of said outer wall, respectively, whereby plural ones of said unit are compactly stackable on each other along said divider structure of each when not in use, said shielding insert being removably insertable in the utility receptacle opening, said shielding insert further characterized by said divider structure including first and second divider walls extending between said opposite parts of said outer wall, said divider structure's first bound at an apex of said divider walls and said divider structure's second bound located at spaced linear edges defined between said first and second divider walls and first and second closure portions, respectively, of said closure thus defined by said divider structure, said spaced linear edges extending from said outer wall and across said interior area, configuration of said outer wall being thus alterable by urging of said divider walls of said divider structure toward one another by a user.

9. The shielding insert of claim 8 wherein said outer wall, said closure portions and said divider structure are configured so that said interior area is completely isolated from the interior of the recessed light fixture receptacle and the interior of the recessed light fixture receptacle is completely closed at the opening thereinto when said shielding insert is inserted in the utility receptacle opening.

10. The shielding insert of claim 8 wherein said unit is made of cardboard, paperboard, or molded pulp product.

11. The shielding insert of claim 8—wherein said outer wall is a truncated conical formation between said first and second bounds of the outer wall.

12. The shielding insert of claim 1 wherein the utility receptacle opening to be engaged is an interior of a cylindrical light fixture receptacle maintained through a wall or a ceiling, the shielding insert thus configured for shielding the interior of the cylindrical light fixture receptacle from intrusion thereinto of foreign substances during wall or ceiling surface treatments, said shield shielding insert further characterized by said outer wall including first and second wall portion portions together defining said outer wall, said outer rim being continuous and extending outwardly from said first and second wall portions, said first and second bounds of said outer wall being curvilinear and said periphery being circumferential, said closure including first and second closure portions extending inwardly across said interior area at said second bound, said divider structure extending between said opposite parts of said outer wall where said wall portions each terminate, each of said sections of said interior area bounded by a different one of said wall portions, said divider structure having first and second bounds extending from said first and second bounds of said outer wall, respectively, said second bound of said divider structure located at a linear edge structure defined between said divider structure and said first and second closure portions, said outer wall, said closure portions and said divider structure configured so that said interior area is completely isolated from the interior of the cylindrical light fixture receptacle and the interior of the cylindrical light fixture receptacle is completely closed at the opening thereinto when the insert is positioned through the utility receptacle opening with said rim in contact with the wall or the ceiling.

13. The insert of claim 12 wherein said first bound of said divider structure is located at an apex of said divider walls and wherein said linear edge structure includes first and second spaced linear edges.

14. The insert of claim 12 wherein said outer wall is a truncated conical formation between said first and second spaced bounds of the outer wall.

15. The insert of claim 12 wherein said outer wall includes first and second stepped sections between said first and second bounds of the outer wall, and wherein said first stepped section of said outer wall has said periphery thereat, and wherein reliefs are formed at a ledge defined between said first and second stepped sections of said outer wall and through said first stepped section thereat.

16. The insert of claim 2 wherein said outer wall includes first and second outer wall portions each originating and terminating at said opposite parts at said divider structure.

17. The insert of claim 2 wherein said outer wall includes first and second stepped sections between said first and second bounds of the outer wall.

18. The insert of claim 3 wherein said material is one of cardboard, paperboard, or molded pulp product.

19. The insert of claim 8 wherein said outer wall includes first and second stepped sections between said first and second bounds of the outer wall, and wherein said first stepped section of said outer wall has said periphery thereat, and wherein reliefs are formed at a ledge defined between said first and second stepped sections of said outer wall and through said first stepped section thereat.

* * * * *